US009132654B1

(12) United States Patent
Dryer et al.

(10) Patent No.: US 9,132,654 B1
(45) Date of Patent: Sep. 15, 2015

(54) LABEL FOR INKJET PRINTHEAD

(71) Applicant: FUNAI ELECTRIC CO., LTD., Osaka (JP)

(72) Inventors: Paul W. Dryer, Lexington, KY (US); Jason Vanderpool, Lexington, KY (US); Richard Warner, Lexington, KY (US); David Bernard, Lexington, KY (US); Andrew Lee McNees, Lexington, KY (US)

(73) Assignee: Funai Electric Co., Ltd. (JP)

( * ) Notice: Subject to any disclaimer, the term of this patent is extended or adjusted under 35 U.S.C. 154(b) by 0 days.

(21) Appl. No.: 14/326,310

(22) Filed: Jul. 8, 2014

(51) Int. Cl.
*B41J 2/175* (2006.01)

(52) U.S. Cl.
CPC ..... *B41J 2/17536* (2013.01)

(58) Field of Classification Search
CPC ..... B41J 2/17536
See application file for complete search history.

(56) References Cited

U.S. PATENT DOCUMENTS 6,164,769 A 12/2000 Inada et al.
6,464,339 B1 * 10/2002 Ardito ..... 347/49
RE41,601 E * 8/2010 Matsuzaki et al. ..... 347/19
7,850,285 B2 12/2010 Yoshihira et al.
8,087,749 B2 1/2012 Goto et al.
8,226,203 B2 7/2012 Noguchi
2007/0263034 A1 * 11/2007 Yoshihira et al. ..... 347/47
2010/0315472 A1 12/2010 Anderson, Jr. et al.

FOREIGN PATENT DOCUMENTS

EP 0622196 A2 * 2/1994 ..... B41J 2/135

* cited by examiner

*Primary Examiner* — Geoffrey Mruk
*Assistant Examiner* — Scott A Richmond
(74) *Attorney, Agent, or Firm* — Amster, Rothstein, Ebenstein LLP

(57) ABSTRACT

A packaging label for an inkjet printhead including a first label portion adapted for adhesion to a first surface of the inkjet printhead, and a second label portion adapted for adhesion to a second surface of the inkjet printhead. The second label portion has a forked configuration including a first outer portion, a second outer portion and a central portion disposed between the first and second outer portions and adapted for adhesion to a packaging tape adhered to a nozzle plate of the inkjet printhead. The adhesion between the second label portion and the second surface of the inkjet printhead is higher than the adhesion between the first label portion and the first surface of the inkjet printhead.

20 Claims, 5 Drawing Sheets

LABEL FOR INKJET PRINTHEAD

FIELD

The present invention relates generally to inkjet printheads, and more particularly, to labels for inkjet printheads.

BACKGROUND

In the shipping and storage of a disposable inkjet printheads, it is necessary to seal the nozzle plate to prevent the ink from drying out and leaking. A well known method of sealing the printhead nozzle plate is by taping with a low tack tape. In order to improve the print quality, the newest generation of nozzle plate uses a photo-imageable nozzle plate (PINP). The PINP material is substantially more fragile than older generation nozzle plates made from metal or polyimide. The more fragile nature of the PINP often results in damage to the nozzle plate upon removal of the tape.

SUMMARY OF THE INVENTION

An object of the present invention is to provide an inkjet label that forces a customer to reduce the tape removal speed so as to reduce the probability of damage to the nozzle plate.

According to an exemplary embodiment, a packaging label for an inkjet printhead comprises: a first label portion adapted for adhesion to a first surface of the inkjet printhead; and a second label portion adapted for adhesion to a second surface of the inkjet printhead, the second label portion having a forked configuration comprising a first outer portion, a second outer portion and a central portion disposed between the first and second outer portions and adapted for adhesion to a packaging tape adhered to a nozzle plate of the inkjet printhead, the adhesion between the second label portion and the second surface of the inkjet printhead being higher than the adhesion between the first label portion and the first surface of the inkjet printhead.

An inkjet printhead according to an exemplary embodiment of the present invention comprises: an ink cartridge body; an ink reservoir disposed within the ink cartridge body and adapted to receive and contain ink; a printhead chip provided on the ink cartridge body and in fluid communication with the ink reservoir so as to receive ink from the ink reservoir for ejection of the ink onto a print medium, the printhead chip comprising a nozzle plate having nozzle holes; a packaging tape adhered to the nozzle plate and adapted for sealing the nozzle holes of the nozzle plate; and a packaging label comprising: a first label portion adapted for adhesion to a first surface of the inkjet printhead; and a second label portion adapted for adhesion to a second surface of the inkjet printhead, the second label portion having a forked configuration comprising a first outer portion, a second outer portion and a central portion disposed between the first and second outer portions and adapted for adhesion to the packaging tape, the adhesion between the second label portion and the second surface of the inkjet printhead being higher than the adhesion between the first label portion and the first surface of the inkjet printhead.

In at least one embodiment, the packaging label comprises a top layer and a bottom layer.

In at least one embodiment, the top layer is made of pearlescent polypropylene.

In at least one embodiment, the bottom layer is made of polyethylene terephthalate.

In at least one embodiment, the bottom layer comprises adhesive.

In at least one embodiment, the top layer has a thickness of about 2.6 mils.

In at least one embodiment, the bottom layer has a thickness of about 1.2 mils.

In at least one embodiment, the first label portion has a length of about 2⅛ inches.

In at least one embodiment, the first label portion has a width of about 11/16 inches.

In at least one embodiment, the second label portion has a length of about 2 inches.

In at least one embodiment, the central portion of the second label portion has a width of about 3/16 inches to about 1/32 inches.

Other features and advantages of embodiments of the invention will become readily apparent from the following detailed description, the accompanying drawings and the appended claims.

BRIEF DESCRIPTION OF THE DRAWINGS

The features and advantages of exemplary embodiments of the present invention will be more fully understood with reference to the following, detailed description when taken in conjunction with the accompanying figures, wherein.

DETAILED DESCRIPTION

Figure 1:
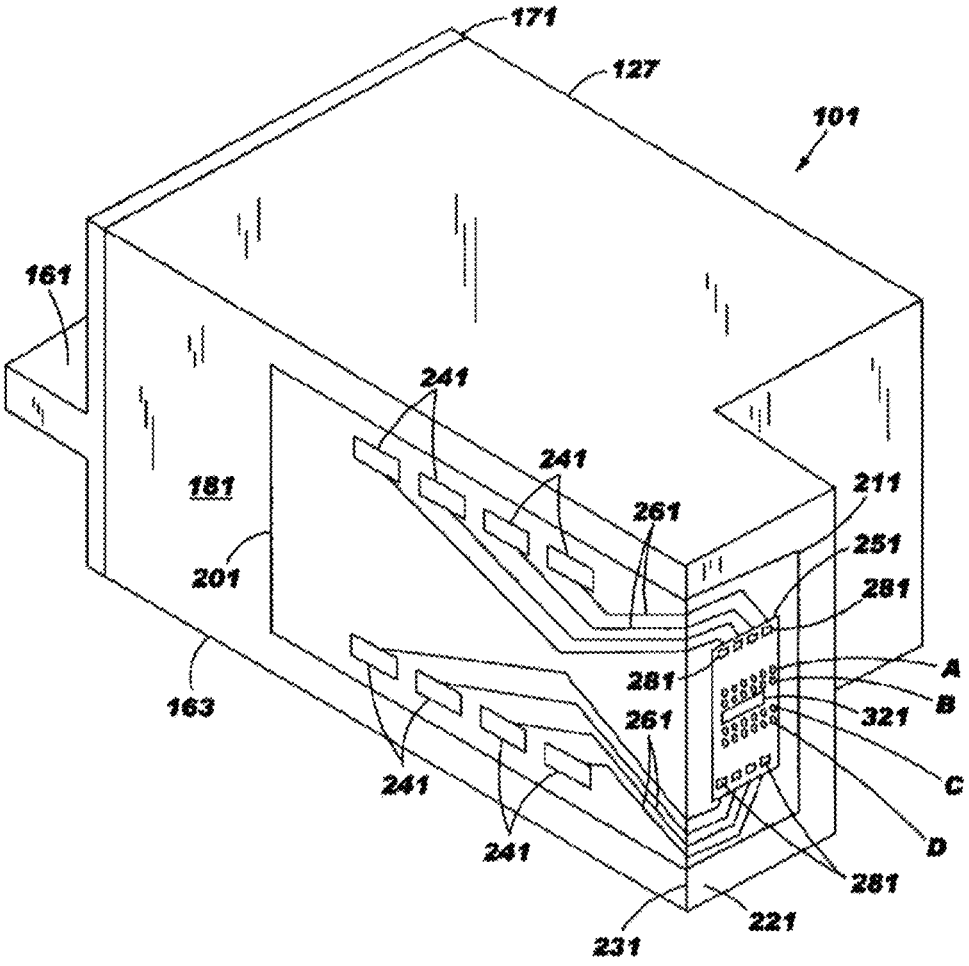
FIG. 1 is a perspective view of a conventional inkjet printhead.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

With reference to FIG. 1, an inkjet printhead according to one embodiment of the present invention to-be-packaged with a nozzle hole sealing tape is shown generally as 101. The printhead 101 has a housing 127 formed of a lid 161 and a body 163 assembled together through attachment or connection of a lid bottom surface and a body top surface at interface 171. The shape of the housing varies and depends upon the external device that carries or contains the printhead, the amount of ink to be contained in the printhead and whether the printhead contains one or more varieties of ink. In any embodiment, the housing or body has at least one compartment in an interior thereof for holding an initial or refillable supply of ink and a structure, such as a foam insert, lung or other, for maintaining appropriate backpressure in the inkjet printhead during use. In one embodiment, the internal compartment includes three chambers for containing three supplies of ink, especially cyan, magenta and yellow ink. In other embodiments, the compartment contains black ink, photo-ink and/or plurals of cyan, magenta or yellow ink. It will be appreciated that fluid connections (not shown) may exist to connect the compartment(s) to a remote source of bulk ink.

A portion 205 of a tape automated bond (TAB) circuit 201 adheres to one surface 181 of the housing while another portion 211 adheres to another surface 221. As shown, the two surfaces 181, 221 exist perpendicularly to one another about an edge 231. The TAB circuit 201 has a plurality of input/output (I/O) connectors 241 fabricated thereon for electrically connecting a heater chip 251 to an external device, such as a printer, fax machine, copier, photo-printer, plotter, all-in-one, etc., during use. Pluralities of electrical conductors 261 exist on the TAB circuit 201 to electrically connect and short the I/O connectors 241 to the bond pads 281 of the heater chip 251 and various manufacturing techniques are known for facilitating such connections. It will be appreciated that while eight I/O connectors 241, eight electrical conductors 261 and eight bond pads 281 are shown, any number are embraced herein. It is also to be appreciated that such number of connectors, conductors and bond pads may not be equal to one another.

The heater chip 251 contains at least one ink via 321 that fluidly connects to a supply of ink in an interior of the housing. Typically, the number of ink vias of the heater chip corresponds one-to-one with the number of ink types contained within the housing interior. The vias usually reside side-by-side or end-to-end. During printhead manufacturing, the heater chip 251 preferably attaches to the housing with any of a variety of adhesives, epoxies, etc. well known in the art. As shown, the heater chip contains four rows (rows A-row D) of fluid firing elements, especially resistive heating elements, or heaters. For simplicity, dots depict the heaters in the rows and typical printheads contain hundreds of heaters. It will be appreciated that the heaters of the heater chip preferably become formed as a series of thin film layers made via growth, deposition, masking, photolithography and/or etching or other processing steps. A nozzle plate, shown in other figures, with pluralities of nozzle holes adheres over or is fabricated with the heater chip during thin film processing such that the nozzle holes align with the heaters for ejecting ink during use. Alternatively, the heater chip is merely a semiconductor die that contains piezoelectric elements, as the fluid firing elements, for electro-mechanically ejecting ink. As broadly recited herein, however, the term heater chip will encompass both embodiments despite the name "heater" implying an electro-thermal ejection of ink. Even further, the entirety of the heater chip may be configured as a side-shooter structure instead of the roof-shooter structure shown.

Figure 2:
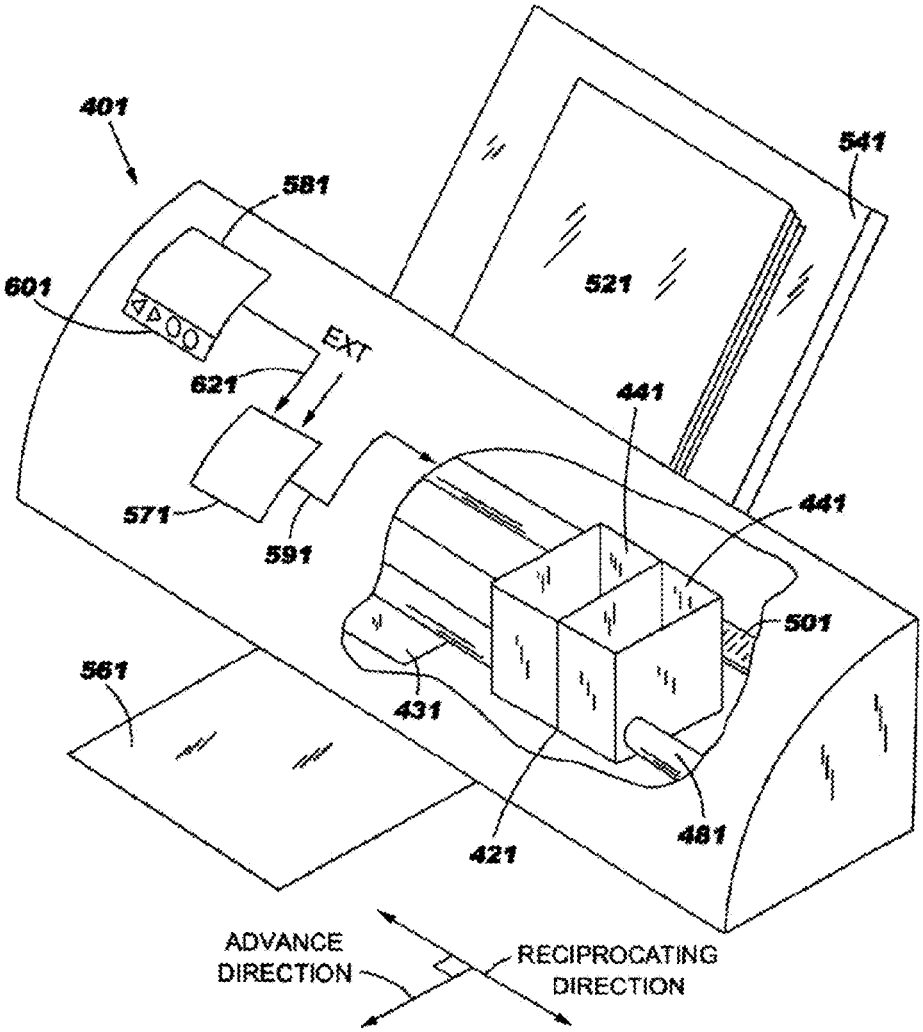
FIG. 2 is a perspective view of a conventional inkjet printer.

With reference to FIG. 2, an external device in the form of an inkjet printer, for containing the printhead 101 after removal of the packaging tape, is shown generally as 401. The printer 401 includes a carriage 421 having a plurality of slots 441 for containing one or more printheads. The carriage 421 is caused to reciprocate (via an output 591 of a controller 571) along a shaft 481 above a print zone 431 by a motive force supplied to a drive belt 501 as is well known in the art. The reciprocation of the carriage 421 is performed relative to a print medium, such as a sheet of paper 521, that is advanced in the printer 401 along a paper path from an input tray 541, through the print zone 431, to an output tray 561.

In the print zone, the carriage 421 reciprocates in the Reciprocating Direction generally perpendicularly to the paper Advance Direction as shown by the arrows Ink drops from the printheads are caused to be ejected from the heater chip 251 (FIG. 1) at such times pursuant to commands of a printer microprocessor or other controller 571. The timing of the ink drop emissions corresponds to a pattern of pixels of the image being printed. Often times, such patterns are generated in devices electrically connected to the controller (via Ext. input) that are external to the printer such as a computer, a scanner, a camera, a visual display unit, a personal data assistant, or other. A control panel 581 having user selection interface 601 may also provide input 621 to the controller 571 to enable additional printer capabilities and robustness.

To print or emit a single drop of ink, the fluid firing elements (the dots of rows A-D, FIG. 1) are uniquely addressed with a small amount of current to rapidly heat a small volume of ink. This causes the ink to vaporize in a local ink chamber and be ejected through the nozzle plate towards the print medium. The fire pulse required to emit such ink drop may embody a single or a split firing pulse and is received at the heater chip on an input terminal (e.g., bond pad 281) from connections between the bond pad 281, the electrical conductors 261, the I/O connectors 241 and controller 571. Internal heater chip wiring conveys the fire pulse from the input terminal to one or many of the fluid firing elements.

Figure 3:
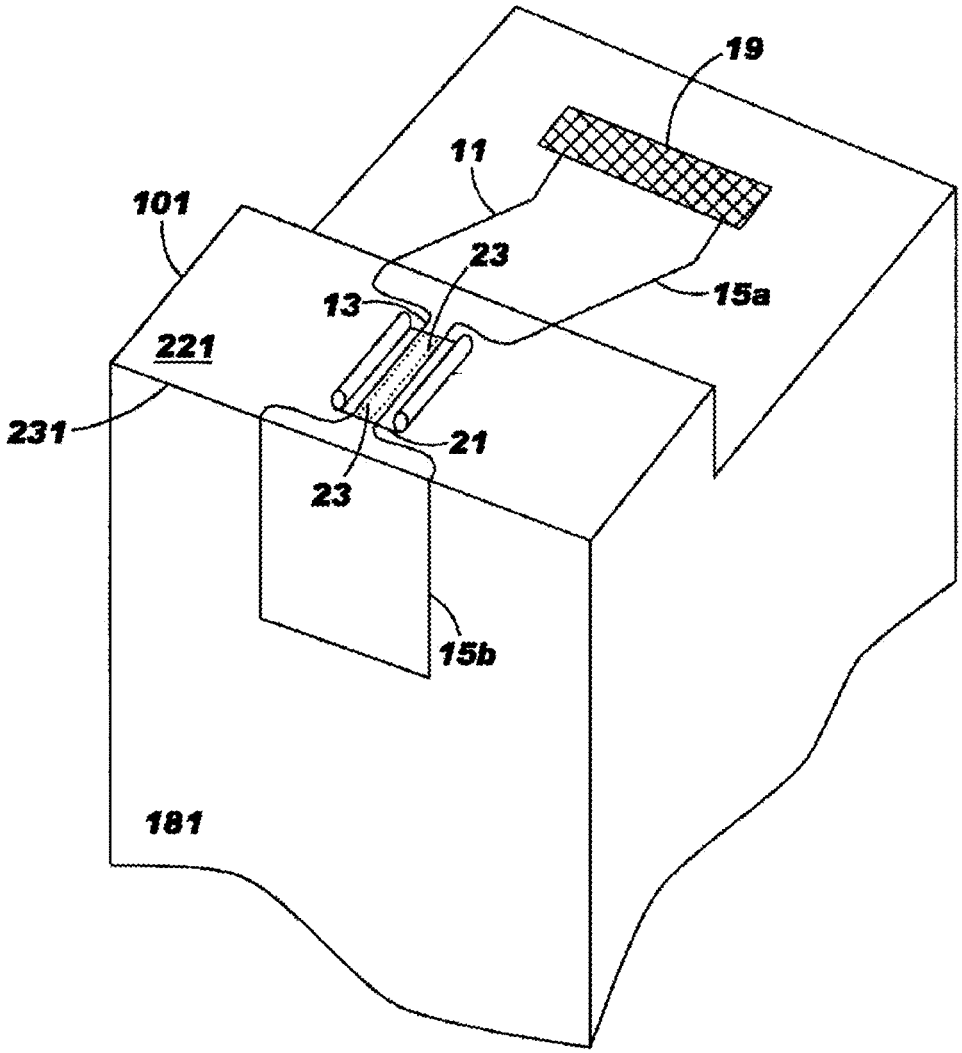
FIG. 3 is a perspective view of a conventional inkjet printhead including a packaging tape.

With reference to FIG. 3, the printhead 101 with a nozzle plate 21 typically has a packaging tape 11 covering the individual nozzle holes 23 of the plate to prevent ink leakage during shipping and handling. The tape 11 is shown sealed over the nozzle plate 21, especially each of the nozzle holes 23, of the inkjet printhead 101. The tape 11 has a narrow-width portion 13 that does not exceed a width of the nozzle plate 21. The label portion of the tape wide portion 15*a* necks-down or tapers to the narrow-width portion 13 on the surface 221 of the printhead 101. The narrow-width portion 13 may neck-up to the wide portion 15*b* on the same surface. A user tab 19 may also be fashioned at an end of the tape 11 for grasping and removing the tape 11 after shipping, but before use.

It has been observed that as the customer increases the speed of the tape removal from the nozzle plate, the probability of damaging the nozzle plate increases, particularly when the nozzle plate is a PINP. In this regard, if the adhesion of the tape is initially high and then reduced as the tape is peeled, damage will occur to the PINP due to the high tape removal speed. Conversely, if the tape adhesion is initially low and then increased as it is peeled, the tape removal speed will decrease, thereby reducing tape damage to the PINP. According to exemplary embodiments of the present invention, this result is achieved by providing a forked label to the sealing tape.

Figure 4:
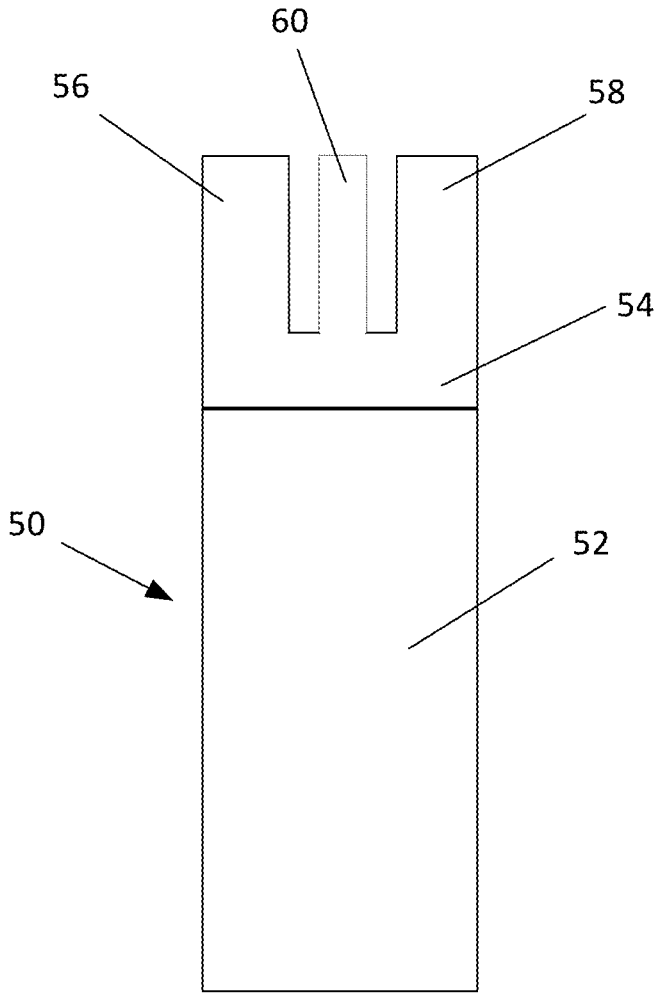
FIG. 4 is a planar view of a packaging label according to an exemplary embodiment of the present invention.

FIG. 4 is a planar view of a packaging label, generally designated by reference number 50, according to an exemplary embodiment of the present invention. The packaging label 50 includes a first label portion 52 and a second label portion 54. The second label portion 54 is intended for sealing over the nozzle plate 21 on the surface 221 of the printhead 101. In this regard, the second label portion 54 has a fork shape, including two outer portions 56, 58 extending on either side of the nozzle plate 21 and a central portion 60 extending over the nozzle plate 21. The central portion 60 is intended for adhering over the narrow tape (not shown) that seals the nozzle holes 23. The second label portion 54 exhibits higher adhesion to the printhead surface as compared to the adhesion exhibited by the first label portion 52. Accordingly, when removing the packaging tape 50 from the printhead, a customer will remove the packaging tape 50 quickly at first, and then be forced to remove the packaging tape 50 at a slower rate when the higher adhesion of the second label portion 54 is encountered. This will prevent damage to the nozzle plate 21 that would otherwise occur with conventional packaging tape.

Figure 5:
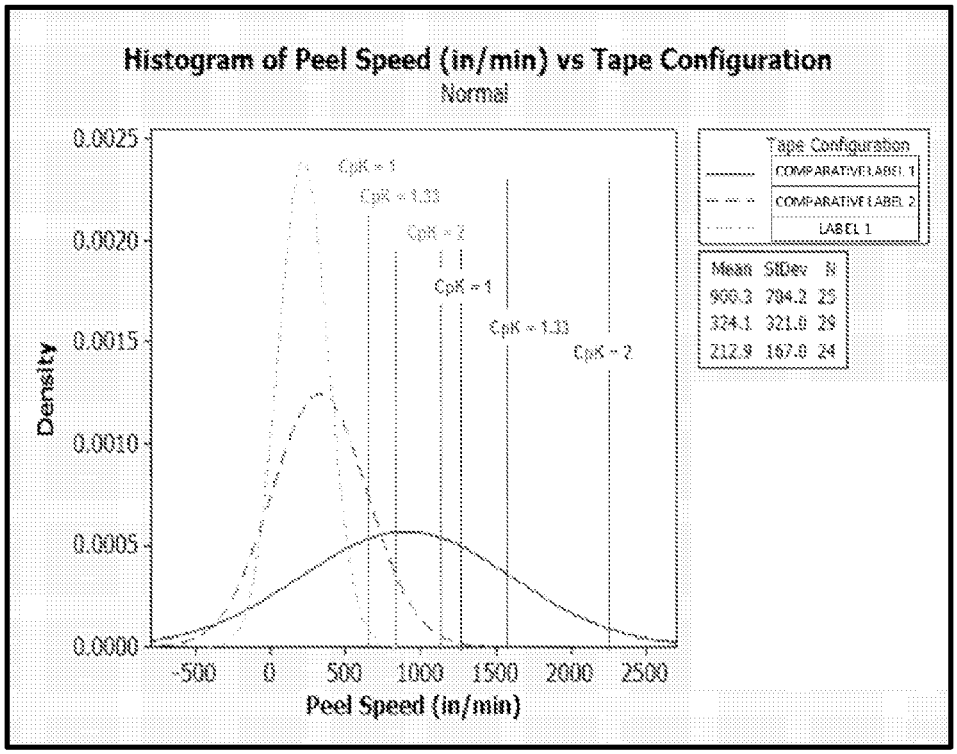
FIG. 5 is a histogram showing comparison of peel speeds of various packaging labels.

In order to demonstrate the effectiveness of the present invention, peel speed of three label configurations were compared. Label 1 was produced in accordance with the present invention, including a first label portion and a second forked label portion disposed over the nozzle plate exhibiting higher adhesion to the printhead surface as compared to the first label portion. Comparative Label 1 was produced with a label attached to the packaging tape, with the label exhibiting higher adhesion to the printhead surface as compared to the packaging tape. Comparative Label 2 was produced with a label attached to the packaging tape, with both the label and the packaging tape exhibiting relatively low adhesion to the printhead surface. Seventy-five printheads were produced, with twenty-five of each configuration. Seventy-five people were video-taped with a high speed camera peeling the printheads as they normally would. FIG. 5 shows a histogram of the speeds that the random people peeled the three different tape configurations. The results are discussed below:

Comparative Label 1: This configuration caused the customer to peel much faster as compared to the Comparative Label 2 and Label 1 configurations. The mean of Comparative Label 1 is 900.3 in/min with a standard deviation of 704.2. Therefore, if the taping configuration starts with high adhesion then reduces, the peel speed will be very fast with a high standard deviation. This is likely because if the adhesion is initially high, the customer applies more peel force (to remove the high adhesion tape) but then continues with the high force through the low adhesion region which causes the tape (over the PINP) to be removed very quickly.

Comparative Label 2: This configuration reduced the customer's peel speed when compared to Comparative Label 1 (324.1 in/min vs 900.3 in/min). Since the initial adhesion is low, little peel force is required initially. Therefore, the customer peels with less force initially and continues removing the tape over the PINP slowly.

Label 1: This configuration caused the customer to remove the tape slowest of all. In this configuration, the adhesion starts low but turns high in the PINP region. The forked design uses high adhesion tape around the PINP but not in contact with the PINP. This configuration causes the customer to initially peel slowly (because of the low initial adhesion) then even slower as they approach the high adhesion fork in the PINP region. This configuration yields the slowest peel speed (212.9 in/min) and the tightest standard deviation (167.0).

While particular embodiments of the invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. A packaging label for an inkjet printhead comprising:

a first label portion adapted for adhesion to a first surface of the inkjet printhead; and a second label portion adapted for adhesion to a second surface of the inkjet printhead, the second label portion having a forked configuration comprising a first outer portion, a second outer portion and a central portion disposed between the first and second outer portions and adapted for adhesion to a packaging tape adhered to a nozzle plate of the inkjet printhead, the adhesion between the second label portion and the second surface of the inkjet printhead being higher than the adhesion between the first label portion and the first surface of the inkjet printhead.

2. The packaging label of claim 1, wherein the packaging label comprises a top layer and a bottom layer.

3. The packaging label of claim 2, wherein the top layer is made of pearlescent polypropylene.

4. The packaging label of claim 2, wherein the bottom layer is made of polyethylene terephthalate.

5. The packaging label of claim 2, wherein the bottom layer comprises adhesive.

6. The packaging label of claim 2, wherein the top layer has a thickness of about 2.6 mils.

7. The packaging label of claim 2, wherein the bottom layer has a thickness of about 1.2 mils.

8. The packaging label of claim 1, wherein the first label portion has a length of about 2⅛ inches.

9. The packaging label of claim 1, wherein the first label portion has a width of about 11/16 inches.

10. The packaging label of claim 1, wherein the second label portion has a length of about 2 inches.

11. The packaging label of claim 1, wherein the central portion of the second label portion has a width of about 3/16 inches to about 1/32 inches.

12. An inkjet printhead comprising:

an ink cartridge body;

an ink reservoir disposed within the ink cartridge body and adapted to receive and contain ink;

a printhead chip provided on the ink cartridge body and in fluid communication with the ink reservoir so as to receive ink from the ink reservoir for ejection of the ink onto a print medium, the printhead chip comprising a nozzle plate having nozzle holes;

a packaging tape adhered to the nozzle plate and adapted for sealing the nozzle holes of the nozzle plate; and a packaging label comprising:

a first label portion adapted for adhesion to a first surface of the inkjet printhead; and a second label portion adapted for adhesion to a second surface of the inkjet printhead, the second label portion having a forked configuration comprising a first outer portion, a second outer portion and a central portion disposed between the first and second outer portions and adapted for adhesion to the packaging tape, the adhesion between the second label portion and the second surface of the inkjet printhead being higher than the adhesion between the first label portion and the first surface of the inkjet printhead.

13. The inkjet printhead of claim 12, wherein the packaging label comprises a top layer and a bottom layer.

14. The inkjet printhead of claim 13, wherein the top layer is made of pearlescent polypropylene.

15. The inkjet printhead of claim 13, wherein the bottom layer is made of polyethylene terephthalate.

16. The inkjet printhead of claim 13, wherein the bottom layer comprises adhesive.

17. The inkjet printhead of claim 12, wherein the first label portion has a length of about 2⅛ inches.

18. The inkjet printhead of claim 12, wherein the first label portion has a width of about 11/16 inches.

19. The inkjet printhead of claim 12, wherein the second label portion has a length of about 2 inches.

20. The inkjet printhead of claim 12, wherein the second label portion has a width of about 3/16 inches to about 1/32 inches.

* * * * *